US006609784B2

(12) United States Patent
Okuda

(10) Patent No.: US 6,609,784 B2
(45) Date of Patent: Aug. 26, 2003

(54) INK JET RECORDING DEVICE AND A METHOD FOR DESIGNING THE SAME

(75) Inventor: Masakazu Okuda, Tokyo (JP)

(73) Assignee: Fuji Zerox Co., Ltd., Tokyo (JP)

( * ) Notice: Subject to any disclaimer, the term of this patent is extended or adjusted under 35 U.S.C. 154(b) by 0 days.

(21) Appl. No.: 10/105,476

(22) Filed: Mar. 25, 2002

(65) Prior Publication Data

US 2002/0135638 A1 Sep. 26, 2002

(30) Foreign Application Priority Data

Mar. 26, 2001 (JP) ..... 2001-087595

(51) Int. Cl.[7] ..... B41J 2/05
(52) U.S. Cl. ..... 347/65
(58) Field of Search ..... 347/65, 94

(56) References Cited

FOREIGN PATENT DOCUMENTS

| | | |
|---|---|---|
| JP | 52-49034 | 4/1977 |
| JP | 53-12138 | 4/1978 |
| JP | 56-75863 | 6/1981 |
| JP | 59-26269 | 2/1984 |
| JP | 10-24568 | 1/1998 |
| JP | 10-193587 | 7/1998 |

*Primary Examiner*—John Barlow
*Assistant Examiner*—Michael S. Brooke
(74) *Attorney, Agent, or Firm*—Katten Muchin Zavis Rosenman

(57) ABSTRACT

An ink jet recording head includes an ink supply system, and a plurality of pressure chambers each including a nozzle for ejecting an ink droplet. The ink supply system has a flow resistance r satisfying the following relationship:

$$r<800/(q\cdot N\cdot f)$$

wherein q, N and f represent the droplet volume ejected from each nozzle, number of pressure chambers, and the ejection frequency, respectively. The ink jet recording head achieves a stable simultaneous ejection from all the nozzles at a higher frequency and for an ink having a higher viscosity.

10 Claims, 12 Drawing Sheets

INK JET RECORDING DEVICE AND A METHOD FOR DESIGNING THE SAME

BACKGROUND OF THE INVENTION (a) Field of the Invention

The present invention relates to an ink jet recording head such as for recording characters or pictures in an ink jet recording device and, more particularly, to an improvement of the ink jet recording head for iteratively ejecting larger-volume ink droplets with a higher stability. The present invention also relates to a method for designing such an ink jet recording head.

(b) Description of the Related Art

Ink jet recording devices using a drop-on-demand scheme attract higher attentions in these, days. Such ink jet recording devices; are disclosed in Patent Publication 53-12138 and described in Laid-Open Publication JP-A-10-193587, for example. In the described devices, a pressure wave generator such as piezoelectric actuator generates a pressure wave in a pressure chamber, ejecting ink droplets through the nozzles communicated to the pressure chamber. FIG. 1 exemplarily shows in ink jet recording head in a conventional ink jet recording device. A pressure chamber 61 is communicated with a nozzle 62 for ejecting ink droplets 67, and an inlet port 64 for receiving therethrough ink from an ink reservoir (not shown) via a common ink passage 63. A diaphragm 65 is provided on the bottom of the pressure chamber 61.

For ejecting ink droplets, a piezoelectric actuator 66 provided on the bottom of the pressure chamber 61 generates a displacement for the diaphragm 65, which in turn generates a volume change for the pressure chamber 61, generating a pressure wave in the pressure chamber 61. The pressure wave allows part of the ink received in the pressure chamber 61 to be ejected outside the pressure chamber 61 through the nozzle 62 as an ink droplet 67. The ejected ink droplet 67 falls onto a recording medium such as a recording sheet, thereby forming an ink dot on the recording sheet.

Iterative formation of the ink dots based on supplied data generates images such as characters and pictures on the recording sheet. The piezoelectric actuator 66 is applied with a driving voltage among driving voltages having a variety of waveforms depending on the volume of the ink droplets to be ejected. A large-volume ink droplet generally used for recording characters or dark images is ejected by applying the driving voltage having a waveform such as shown in FIG. 2.

The driving waveform has a rising edge 151 for raising the voltage applied to the piezoelectric actuator 66 thereby reducing the volume of the pressure chamber 61 for ejection of the ink, a flat level having a voltage V1 and a falling edge 152 for recovering the original voltage level or the normal voltage Vb.

FIGS. 3A to 3F are sectional views of a nozzle in the ink jet recording head, consecutively showing the ink meniscus in the vicinity of the nozzle during application of the driving waveform. The meniscus 72 has a flat surface prior to volume reduction of the pressure chamber, as shown in FIG. 3A, then moves toward outside the nozzle 71 due to the volume reduction of the pressure chamber, ejecting an ink droplet 73, as shown in FIG. 3B. After the ejection of the ink droplet 73, the volume of the ink inside the nozzle 71 is reduced, forming a concave meniscus surface shown in FIG. 3C. The meniscus 72 then recovers the original shape due to the surface tension of the ink, as shown consecutively in FIGS. 3D to 3F.

FIG. 4 shows the positional profile of the meniscus surface shown in FIGS. 3C to 3F at the center of the meniscus with the elapsed time "t" just after the ink ejection. As shown in the drawing, the meniscus surface largely retracts toward the position y=−60 $\mu$m at the time instant t=0, and eventually recovers to the original position y=0, or the position at the outer edge of the nozzle, after some vibration due to the function of the surface tension of the ink.

The recovery movement of the ink meniscus after the ejection of ink droplet is referred to as "refill" or "refill operation" in this text. The time length $t_r$ for the meniscus to recover the original position y=0, or the outer edge of the nozzle, after the ink ejection is referred to as a "refill time" in this text.

In iterative ejection of the ink droplets by using the ink jet recording head, an ejection operation should be effected after the completion of the refill operation resulting from the prior ejection in order to obtain a constant volume or a constant velocity of the ink droplet. That is, if the next ejection is effected before completion of the refill of the prior ejection, a stable iterative ejection cannot be obtained.

The factors largely affecting the maximum ejection frequency of the ink jet recording head include the refill time $t_r$ as described above and the number of nozzles. A larger number of nozzles increase the number of dots to be formed in a unit time length, thereby improving the maximum ejection frequency. In view of this fact, a conventional ink jet recording device is of a multi-nozzle type wherein a plurality of ejectors are juxtaposed and coupled together.

FIG. 5 shows a conventional multi-nozzle ink jet recording head. An ink reservoir 97 is communicated with a common ink passage 93, which is in turn communicated with a plurality of pressure chambers 91 via respective inlet ports (not illustrated). This arrangement allows the plurality of ejectors to eject ink droplets at a times thereby reducing the time length seeded for printing.

It is to be noted that the common ink passage 93 should be suitably designed in order to obtain a stable iterative ejection in the ink jet recording head. More specifically, for example, cross-talk of the pressure should be prevented between the ejectors which are communicated with the common ink passage. In addition, the difference in the ejection characteristics between the ejectors should be also reduced, the ejection characteristics depending on the positions of the connection to the common ink passage. In this respect, it is important that the common ink passage have a sufficient acoustic capacitance. Some head structures satisfying the above conditions have been proposed heretofore.

For example, JP-A-56-75863 describes an ink jet recording head including a common ink passage having a volume defined based on the volume of the pressure chambers. Each of JP-A-5249034 and JP-A-10-24568 describes the structure of a common ink passage accompanied with air damper for obtaining a larger acoustic capacitance for the common ink passage having a small size. JP-A-59-26269 describes a quantitative definition of the acoustic capacitance (or impedance) needed for the common ink passage. As described in these publications, a sufficient acoustic capacitance of the common ink passage prevents mutual interference between ejectors, thereby achieving a stable and uniform ink ejection among the plurality of ejectors communicated with the common ink passage.

Even if the above-described conditions are satisfied in the conventional multi-nozzle ink jet recording heads, however, a stable ink ejection is not always achieved depending on other factors, as detailed below.

The first case of the unstable ink ejection arises when a plurality of ejectors eject relatively large ink droplets at the same time with a higher frequency. In this ejection, the volume of the ejected ink droplet is unstable: large-volume ink droplets and small-volume ink droplets are alternately ejected, for example. In addition, the velocity of the ejected ink droplet is also unstable. An excessively unstable droplet velocity may cause that the nozzle receives air bubbles in the ink and eventually results in a non-ejection problem.

FIG. 6 shows the stability of the ink ejection obtained by changing the volume of the ink droplet and the ejection frequency in a conventional ink jet recording head. The stability is evaluated based on the change of the droplet velocity. As shown, when 32 ejectors in number simultaneously ejected ink droplets having a volume of 25 pico-litters (or $25\times10^{-15}$ $m^3$), the droplet velocity was unstable at frequencies above 11 kHz, and exhibited non-ejection at frequencies above 18 kHz. Observation of the ejection by a stroboscope revealed frequent occurrences of a case wherein large-volume droplets and small-volume droplets were ejected alternately at ejection frequencies above 11 kHz. In another case, the droplet volume and the droplet velocity were changed at random. When a larger droplet volume of 30 pico-litters was selected, similar results were observed at frequencies above 9 kHz.

The unstable ink ejection as described above was scarcely observed in the ejection of a small-volume droplet or ejection of a larger-volume droplet at a lower frequency. This means that a sufficient suppression of cross-talk was achieved, which in turn means that a sufficient acoustic capacitance was obtained for the common ink passage. The unstable ink ejection was also scarcely observed when the number of ejectors operating at the same was small. It was confirmed that all the ejectors communicated with the common ink passage revealed similar instability. These results of observations lead to a conclusion that the instability of the ink ejection did not result from the cross-talk. This necessitated investigation of the new factors of the unstable ejection, which were not considered heretofore, as well as the solution of the unstable ejection.

The problem of the unstable ejection may be a bar against developments of ink jet recording heads because the ink jet recording heads are requested to have a higher printing speed, which is attempted by an increase of the number of ejectors and of the ejection frequency, as well as an increase of the volumes of the ink droplets, i.e. expansion of the modulation range of the volume of the ink droplets.

The second case of the unstable ink ejection arises when an ink having a higher viscosity is used. FIG. 7 shows the stability of the ink ejection obtained by using inks having different value for the viscosity. When an ink having a viscosity of 3 mPa·s was used, the stability of the ink ejection was lost at frequencies above 11 kHz in the case of 32 ejectors simultaneously ejecting ink droplets having a volume of 25 pico-litters. When an ink having a viscosity of 6 mPa·s was used, the stability of the ink ejection was lost at frequencies above 6 kHz in a similar case. Observation of the ink ejection by a stroboscope revealed frequent occurrences of a case wherein large-volume droplets and small-volume droplets were ejected alternately, similarly to the case of attempting ejection of a large-volume droplet. Thus, it is considered that the instability of the ink ejection caused by using an ink having a higher viscosity results from a reason similar to the reason which raises the instability of the iterative ejection of ink droplets having a large volume. It is confirmed that a higher ink viscosity increases the instability of the ink ejection.

Current developments of the ink jet recording head highlight the increase in the ink viscosity because the demand for a high-performance ink is increasing. The development of the high-performance ink is directed to improvement in the recording performance of the current ink with respect to the regular sheet as well as a ultra-high printing speed thereon. This may be achieved partly by the increase of the ink viscosity.

The higher ink viscosity, however, prevents the ink jet recording head from ejecting ink droplets having a large volume at a higher frequency, as described before, thereby raising a problem in practical introduction of the ink having a higher viscosity. Thus, the suppression of the unstable ink ejection is one of the most important subjects for the ink jet recording head, in the view point of practical introduction of such a high-viscosity ink as well.

SUMMARY OF THE INVENTION

It is an object of the present invention to provide an ink jet recording head for use in an ink jet recording device which is capable of suppressing unstable ink ejection when a plurality of ejectors simultaneously eject large-volume ink droplets at a higher frequency and thus being adapted to a high-speed printing.

It is another object of the present invention to provide an ink jet recording head for use in a recording device which is capable of suppressing unstable ink ejection during ejecting a high-viscosity ink and being adapted to a variety of ink viscosities.

It is a further object of the present invention to provide a method for designing such an ink jet recording head.

The present invention provides an ink jet recording head including an ink supply system having an ink reservoir and a common ink passage communicated to the ink reservoir, a plurality of pressure chambers each-communicated to the common ink passage, each of the pressure chambers including an ink nozzle for ejecting ink from a corresponding one of the pressure chambers, wherein a flow resistance r [Ns/$m^5$] of the ink supply system generated at a static ink flow satisfies the following relationship:

$$r<800/(q\cdot N\cdot f),$$

wherein q, N and f represent a droplet volume [$m^3$] of an ink droplet ejected by each of the nozzles at a time, a number of the pressure chambers and an ejection frequency for ejecting the ink droplets, respectively.

The present invention also provides a method for designing an ink jet recording head having an ink supply system including an ink reservoir and a common ink passage communicated to the ink reservoir, a plurality of pressure chambers each communicated to the common ink passage, each of the pressure chambers including an ink nozzle for ejecting ink from a corresponding one of the pressure chambers, the method including the step of determining a flow resistance of the ink supply system during a static flow in the ink supply system to suppress a refill time for each of the nozzles down to below a specified ejection frequency designed for the nozzles.

In accordance with the inkjet recording head of the present invention and the ink jet recording head designed by the method of the present invention, a stable iterative and simultaneous ejection by a plurality of ejectors can be obtained at a higher ejection frequency as well as fort the case of an ink having a higher viscosity.

PREFERRED EMBODIMENTS OF THE INVENTION

Before describing embodiments of the present invention, the principle of the present invention will be described for a better understanding of the present invention.

Figure 5:
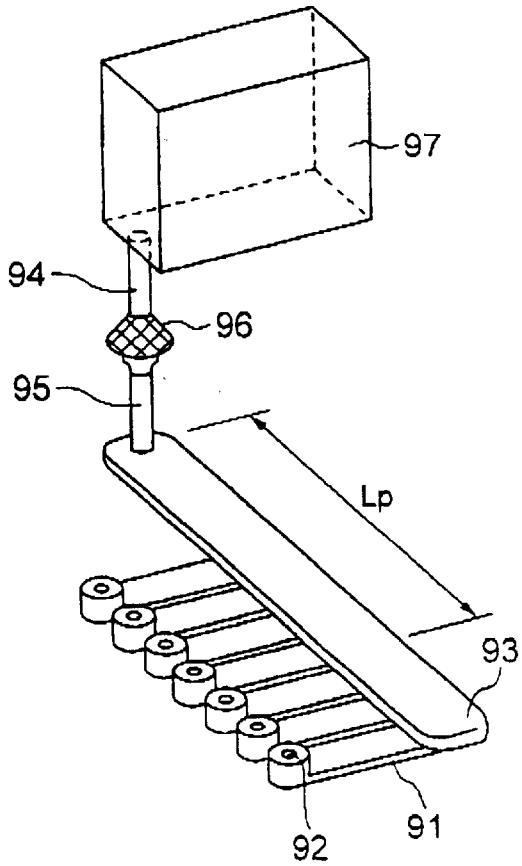
FIG. 5 PRIOR ART
FIG. 5 is a perspective view of a typical multi-nozzle ink jet recording head.
Figure 6:
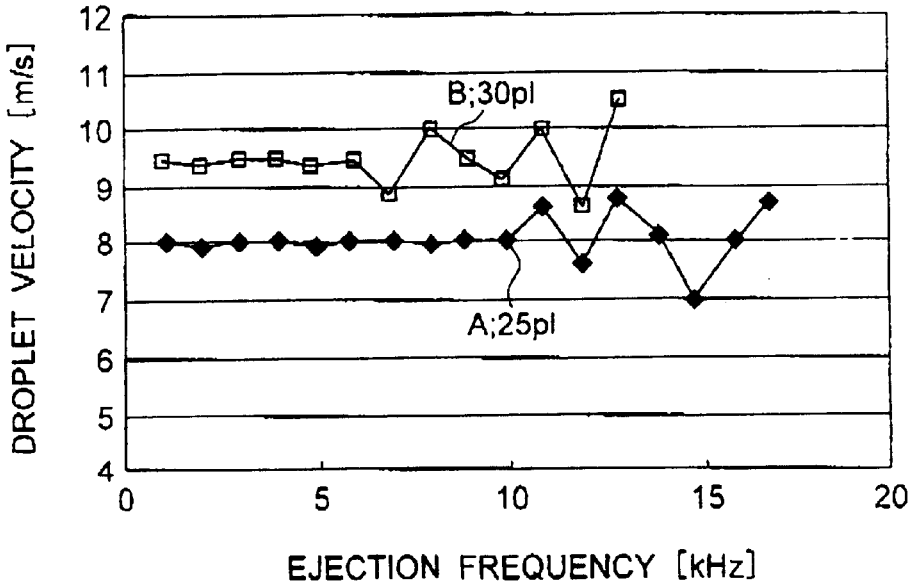
FIG. 6 is a graph showing the relationship between the droplet velocity and the ejection frequency in the typical, multi-nozzle ink jet recording head, with the droplet volume being a parameter.
Figure 7:
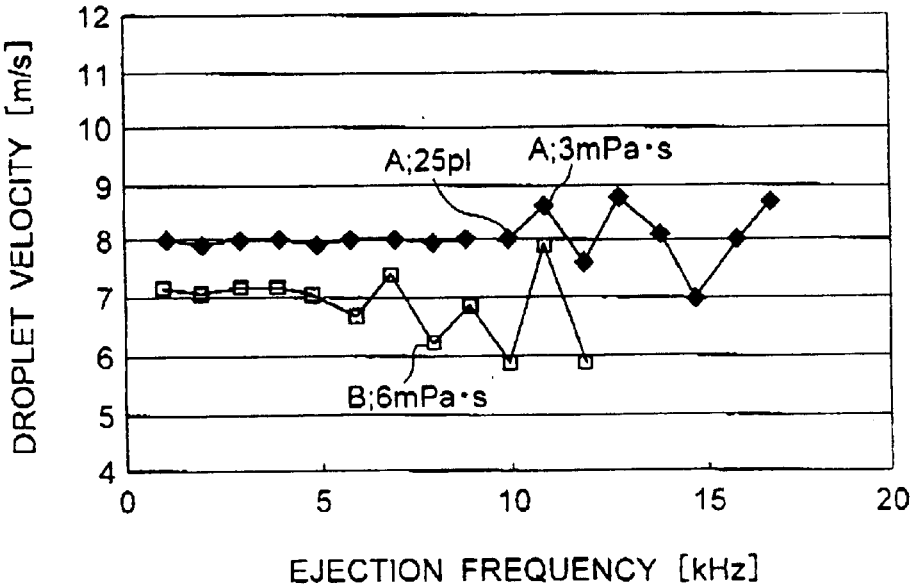
FIG. 7 is a graph showing the relationship between the droplet velocity and the ejection frequency in the typical multi-nozzle ink jet recording head, with the ink viscosity being a parameter.
Figure 8:
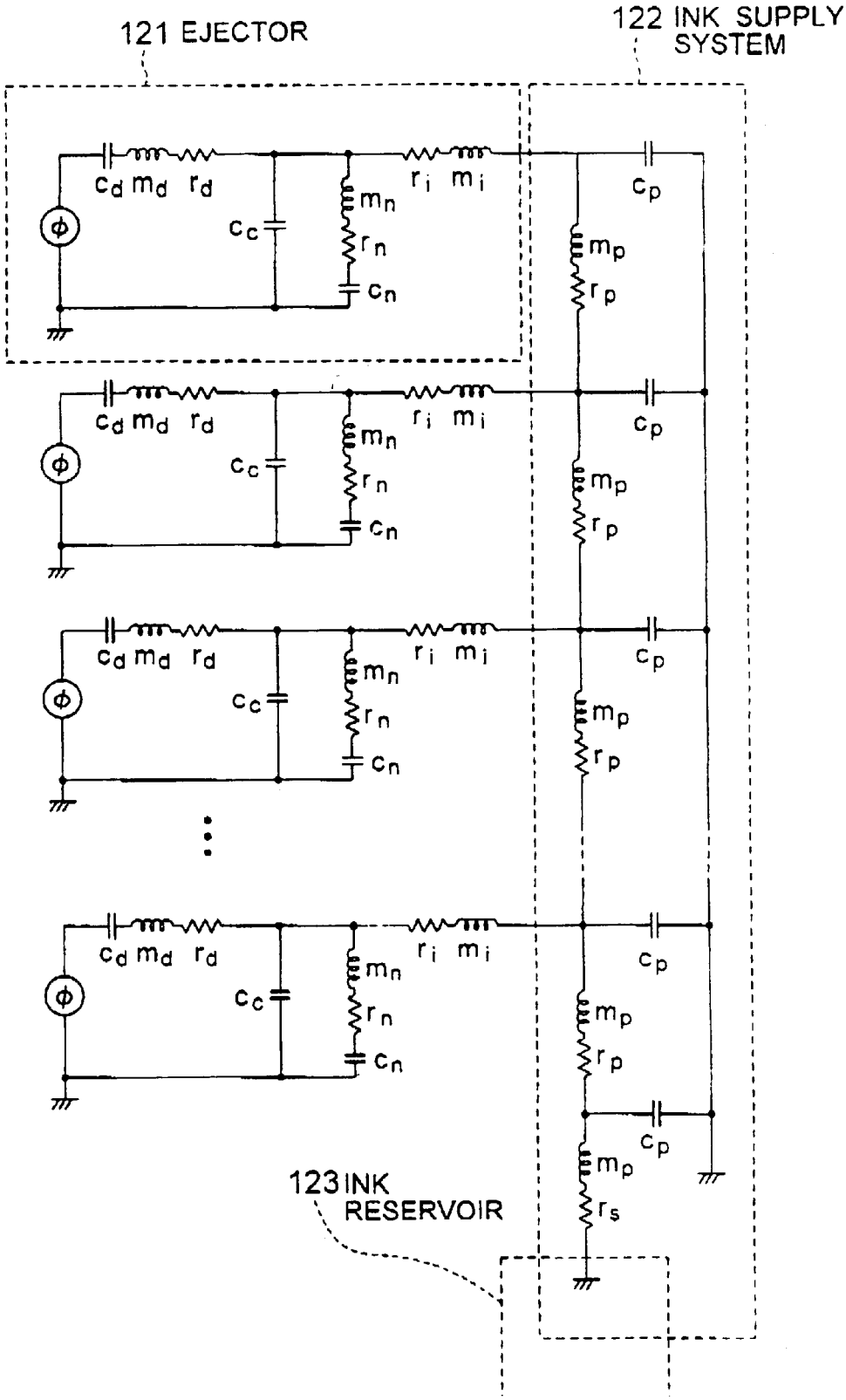
FIG. 8 is an equivalent diagram of the typical multi-nozzle ink jet recording head during a refill operation.

Referring to FIG. 8, an equivalent circuit diagram of the ink jet recording head represents the multi-nozzle ink jet recording head shown in FIG. 5. The equivalent circuit includes a plurality of ejectors 121, and an ink supply system 122 including a common ink passage and an ink reservoir 123. In the equivalent circuit diagram, symbols "m", "r", "c" and "ϕ" represent inertance (kg/m$^4$), flow resistance or acoustic resistance (Ns/m$^5$), acoustic capacitance (m$^5$/N) and pressure (Pa), respectively, whereas the subscripts "d", "c", "i", "n", "p" and "s" represent that the affixed symbols are of actuator, pressure chamber, ink inlet port, nozzle, common ink passage, and ink supply system other than the common ink passage, respectively.

In the design of a conventional ink jet recording head, the acoustic capacitances, such as $c_p$ and the inertances, such as $m_p$ are designed based on the consideration of propagation of a pressure wave, which is generated in the pressure chamber during ink ejection through each of the ejectors, assuming that ejection of a single ink droplet is effected through each of the ejectors. More specifically, a transient state of the single ink ejection shown in FIG. 8 is used for the design of the ink jet recording head without consideration of prior or subsequent ink ejection, the transient state being generally differentiated from a static state wherein ink ejection is not effected or the pressure wave is not propagated.

Figure 9:
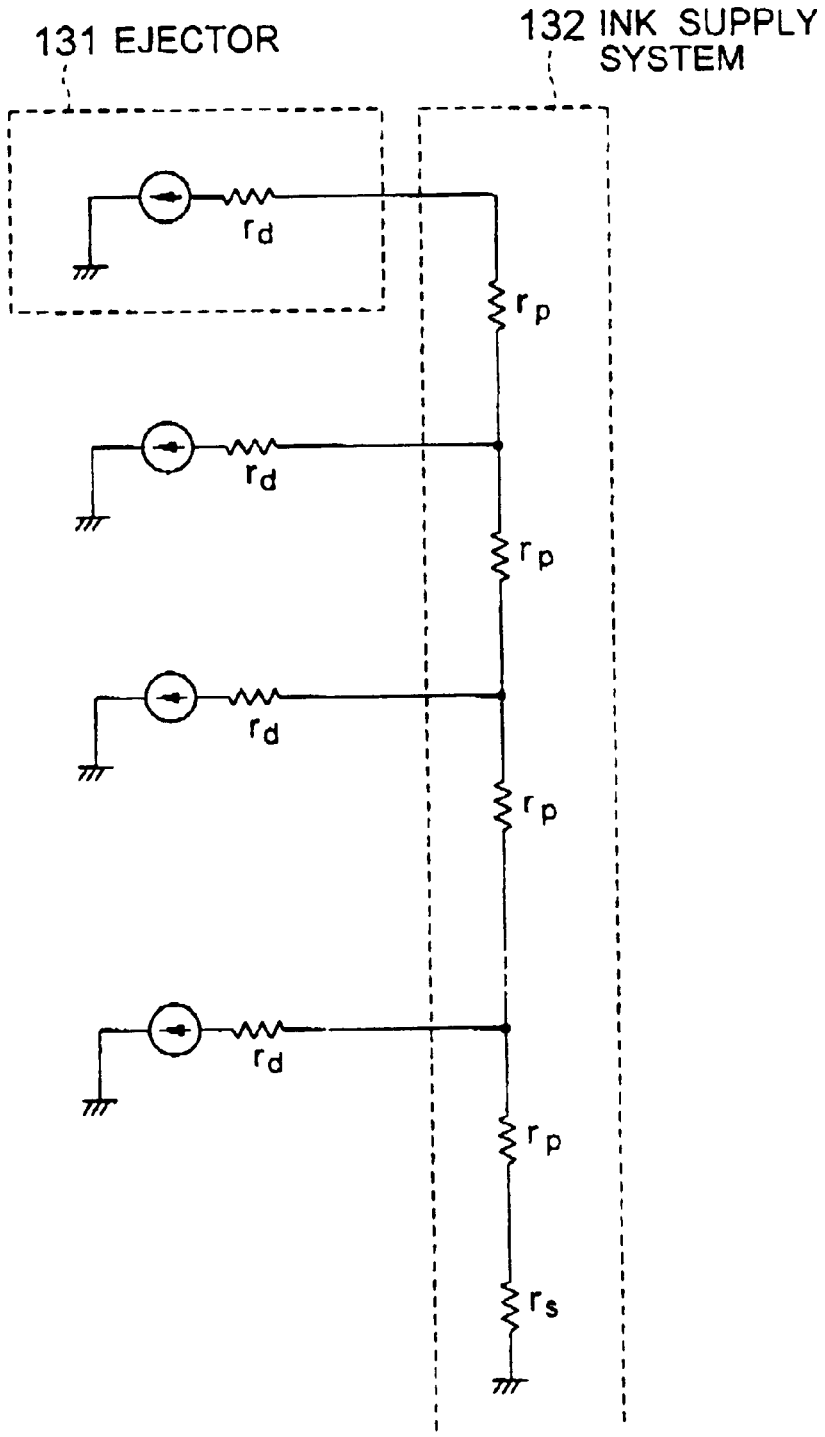
FIG. 9 is a simplified equivalent diagram of the typical multi-nozzle ink jet recording head during a refill operation.

On the other hand, when ink droplets are iteratively ejected, there arises a static ink flow from the ink reservoir to the nozzles in a macroscopic view point. The static ink flow is supplied through the common ink passage to the ejectors. In this macroscopic view point, the equivalent circuit diagram shown in FIG. 8 can be simplified as the equivalent circuit diagram shown in FIG. 9.

The flow resistance is noticed here in the whole ink supply system 132 from the ink reservoir to the common ink passage. When a fluid flows through a pipe line having a resistance of "r" at a flow rate Q, a pressure difference $\Delta P = r \cdot Q$ is generated between the inlet and the outlet of the pipe line based on the Hagen Poiseuille's law. If the ink consumption, i.e., ejected amount of ink from the ejectors is large, then the ink flows through the ink supply system 132 at a large flow rate. In this case, a large flow resistance of the ink supply system 132 generates a large pressure difference between the ink resevoir and the common ink passage. The flow resistance of the ink supply system is obtained as a sum of the flow resistance of the common ink passage and the flow resistance of the ink supply system other than the common ink supply system.

A practical quantitative example is presented hereinafter. Assuming that the volume of an ink droplet ejected from each ejector and the ejection frequency are 25 pico-litters and 20 kHz, respectively, the amount of ink ejected from each nozzle is $5\times10^{-10}$ m$^3$/s. Assuming further that the number of ejectors communicated to the common ink passage is 128, the ink consumption or flow rate of ink is $6.4\times10^{-8}$ m$^3$/s if all the ejectors iteratively and simultaneously eject the ink droplets.

In calculation of the flow resistance of the ink supply system, the flow resistance $r_1$ of a part of the ink supply system implemented by a pipe line having a circular cross section is calculated from the following formula:

$$r_1 = \Sigma(128\eta L/\pi d^4) \quad (1),$$

wherein d, L and η are diameter (meter: m) of the pipe line, length (meter) of the pipe line and the ink viscosity (Pa·s), respectively. Similarly, the flow resistance $r_2$ of another part of the ink supply system implemented by a pip line having a rectangular cross section is calculated from the following formula:

$$r_2 = \Sigma[128\ \eta L\{0.33+1.02(z+1/z)\}/S^2] \quad (2),$$

wherein S and z are the cross-sectional area and the aspect ratio, respectively, of the pipe line.

The total flow resistance r of the ink supply system is obtained by the sum of $r_1$ and $r_2$. The flow resistance of the ink supply system is calculated based on the formulas (1) and (2) in the embodiments to follow.

Assuming that the ink supply system is implemented by a circular pipe line having a diameter of 0.8 mm and a length of 50 mm, and that the ink has a viscosity of 3 mPa·s, the ink'supply system has a flow resistance of $1.5\times10^{10}$ Ns/m$^5$. Thus, ejection of ink droplets each having a volume of 25 pico-litters from all the ejectors at an ejection frequency of 20 kHz generates a pressure drop of 960 Pa along the ink supply system or in the common ink passage.

In the refill operation as described before, the ink is introduced from the common ink passage to the pressure chamber by the pressure generated by the surface tension of the meniscus. For a rapid refill operation, it is preferable that a larger pressure difference be generated between the common passage and the nozzle. If the pressure difference generated by the surface tension of the meniscus is reduced, the time length for the refill operation increases accordingly. Thus, it is preferable that a large pressure difference be generated between the common ink passage and the nozzles and that the pressure drop along the common ink passage be reduced or suppressed for the rapid refill operation.

It is to be noted that the simultaneous and iterative ink ejection by the ejectors is likely to generate a large pressure drop in the common ink passage, and thus reduce the pressure different between the common ink passage and the nozzles. This reduces the refill speed and increases the time length of the refill operation.

Figure 10:
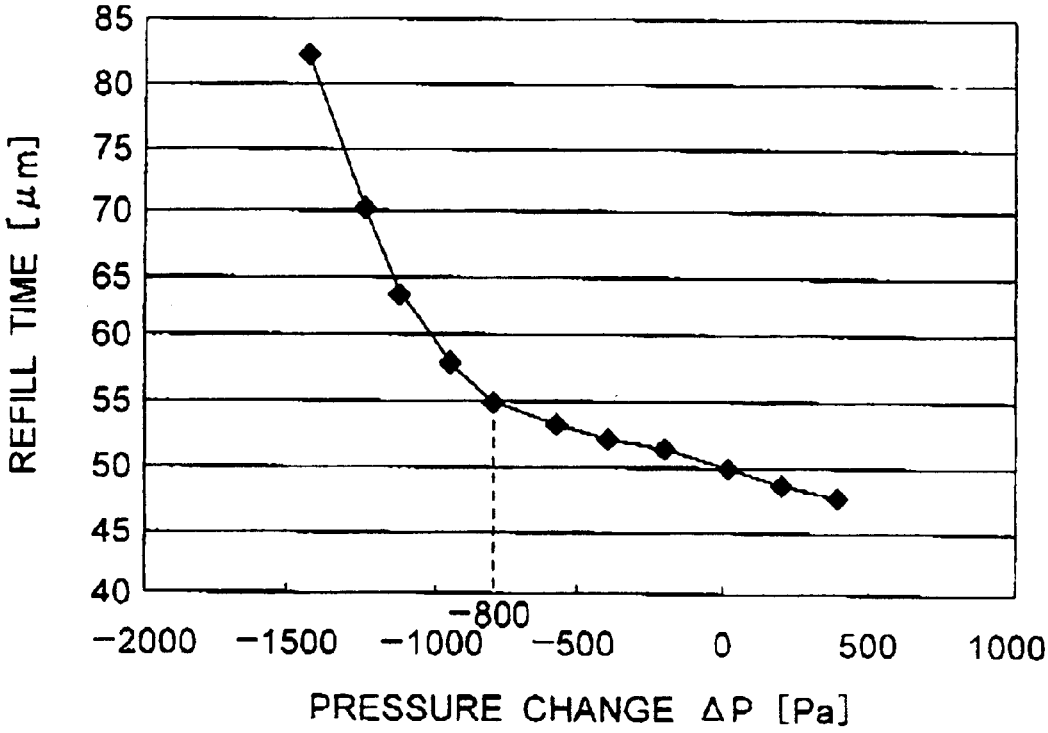
FIG. 10 is a graph showing the relationship between the refill time and the pressure change in the pressure chamber.

FIG. 10 shows the relationship experimentally obtained between the refill time $t_r$ ($\mu$s) and the pressure change $\Delta P$ (Pa) at the common ink passage. The pressure change at the pressure chamber may be considered to be a pressure drop during operation of the ink jet recording head. Thus, the graph in fact reveals that lower pressure drops below 800 Pa in the common ink passage can provide a substantially constant refill time, as observed at the right side of the dotted line extending vertically at −800 Pa in FIG. 10. On the other hand, higher pressure drops above 800 Pa abruptly increase the refill time, as shown at the left side of the dotted line.

The relationship between the refill time and the pressure drop may be changed to some extent depending on the surface tension of the ink, nozzle diameter etc. Generally, in an ink jet recording head having a nozzle diameter of 15 to 40 $\mu$m and operating with an ink having a surface tension of 20 to 40 mN/m, a suitable refill speed can be assured if the pressure drop in the common ink passage resides below 800 Pa.

Thus, the flow resistance "r" of the ink supply system should satisfy the following relationship:

$$r<800/(q\cdot N\cdot f) \quad (3),$$

wherein N, q and f represent the number of pressure chambers (or ejectors) communicated with the common ink passage, the volume of the ink droplet ejected from a single nozzle at a time, and the ejection frequency, respectively.

The relationship (3) is applied to the above-exemplified multi-nozzle ink jet recording head having a pressure drop of 960 Pa in the common ink passage. In this case, the refill time increases from the case of a pressure drop of 800 Pa by about 8 microseconds up to 58 micro-seconds. This causes the refill time to adapt to an ejection frequency of 20 kHz or an ejection period of 50 micro-seconds, whereby abnormal ejection operation cannot be obtained to result in an unstable ejection. It is to be noted that, if the flow resistance of the ink supply system is set at or below $1.25\times$Ns/m$^5$, the pressure drop in the common ink chamber is suppressed down to 80 Pa or below. If this is possible; the simultaneous and iterative ejection by all the ejectors at an ejection frequency of 20 kHz or above does not cause an unstable ejection operation.

As described heretofore, the ink jet recording head of the present invention defines an ink supply system which does not significantly increase the refill time by consideration of the pressure drop in the common ink passage during the iterative ejection and the influence on the refill time by the pressure drop.

Now, the present invention is more specifically described with reference to preferred embodiments thereof.

Figure 1:
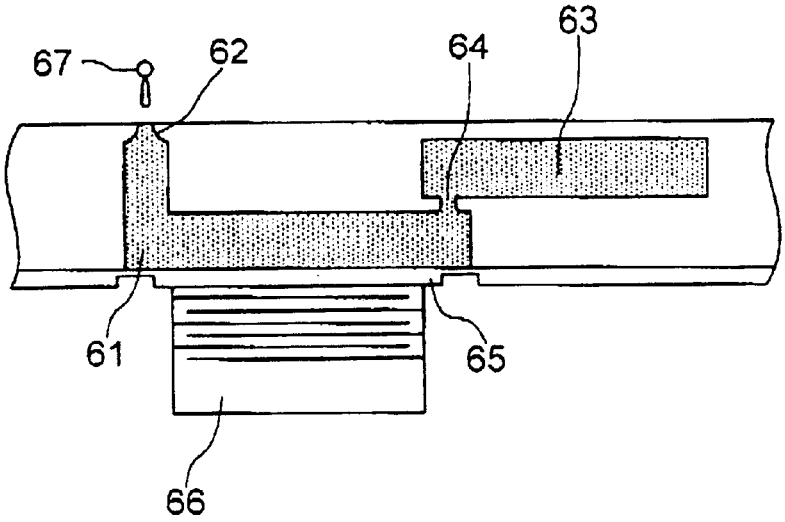
FIG. 1 PRIOR ART
FIG. 1 is a sectional view of a typical ink jet recording head.
Figure 2:
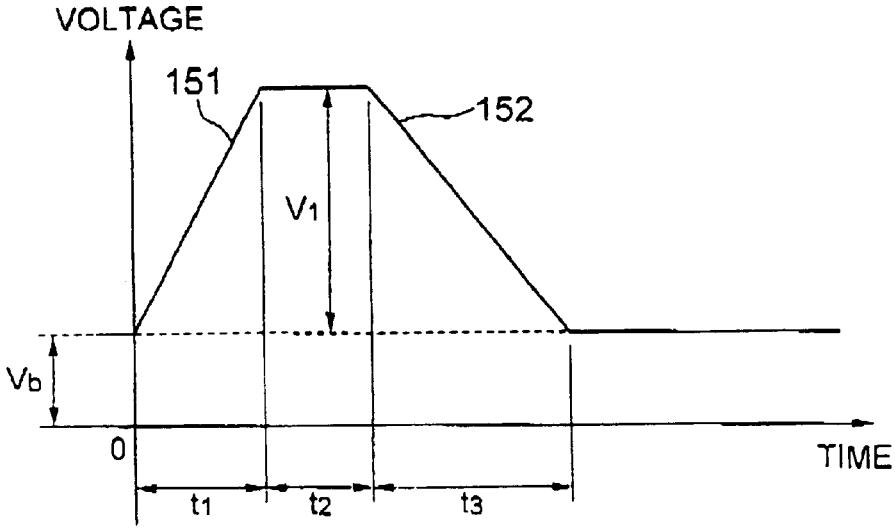
FIG. 2 PRIOR ART
FIG. 2 is graph showing a drive waveform applied to a piezoelectric actuator in the typical ink jet recording head.
Figure 3A:
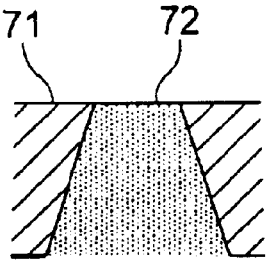
FIG. 3A PRIOR ART
FIGS. 3A to 3F are schematic sectional views of a nozzle in the typical ink jet recording head, consecutively showing the meniscus therein.
Figure 3B:
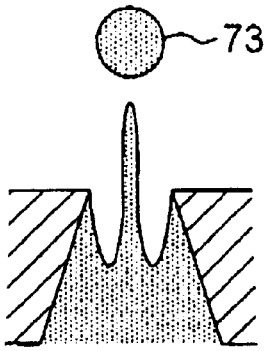
FIG. 3B PRIOR ART
Figure 3C:
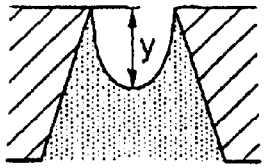
FIG. 3C PRIOR ART
Figure 3D:
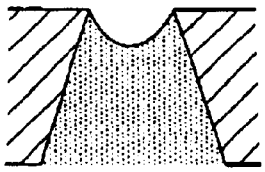
FIG. 3D PRIOR ART
Figure 3E:
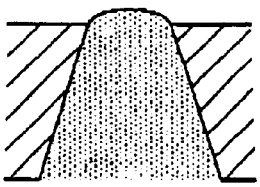
FIG. 3E PRIOR ART
Figure 3F:
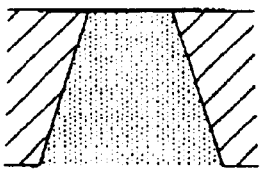
FIG. 3F PRIOR ART
Figure 4:
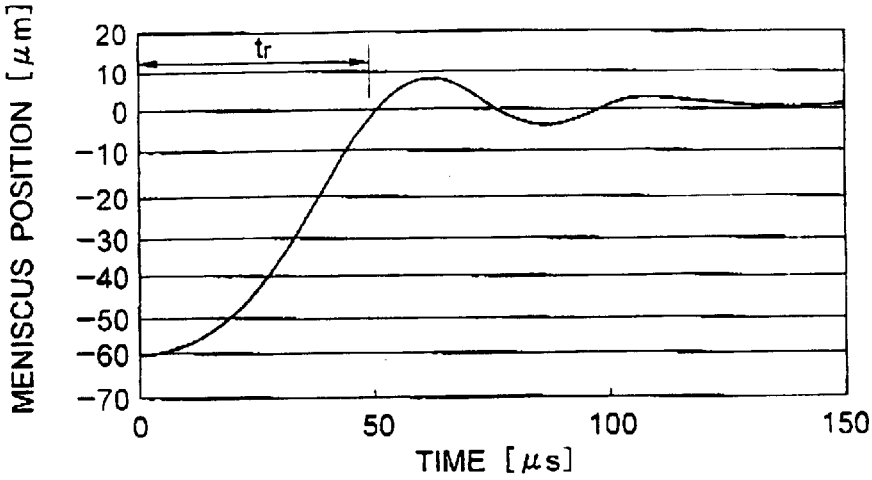
FIG. 4 is a graph showing the timing chart of the movement of the meniscus.
Figure 11:
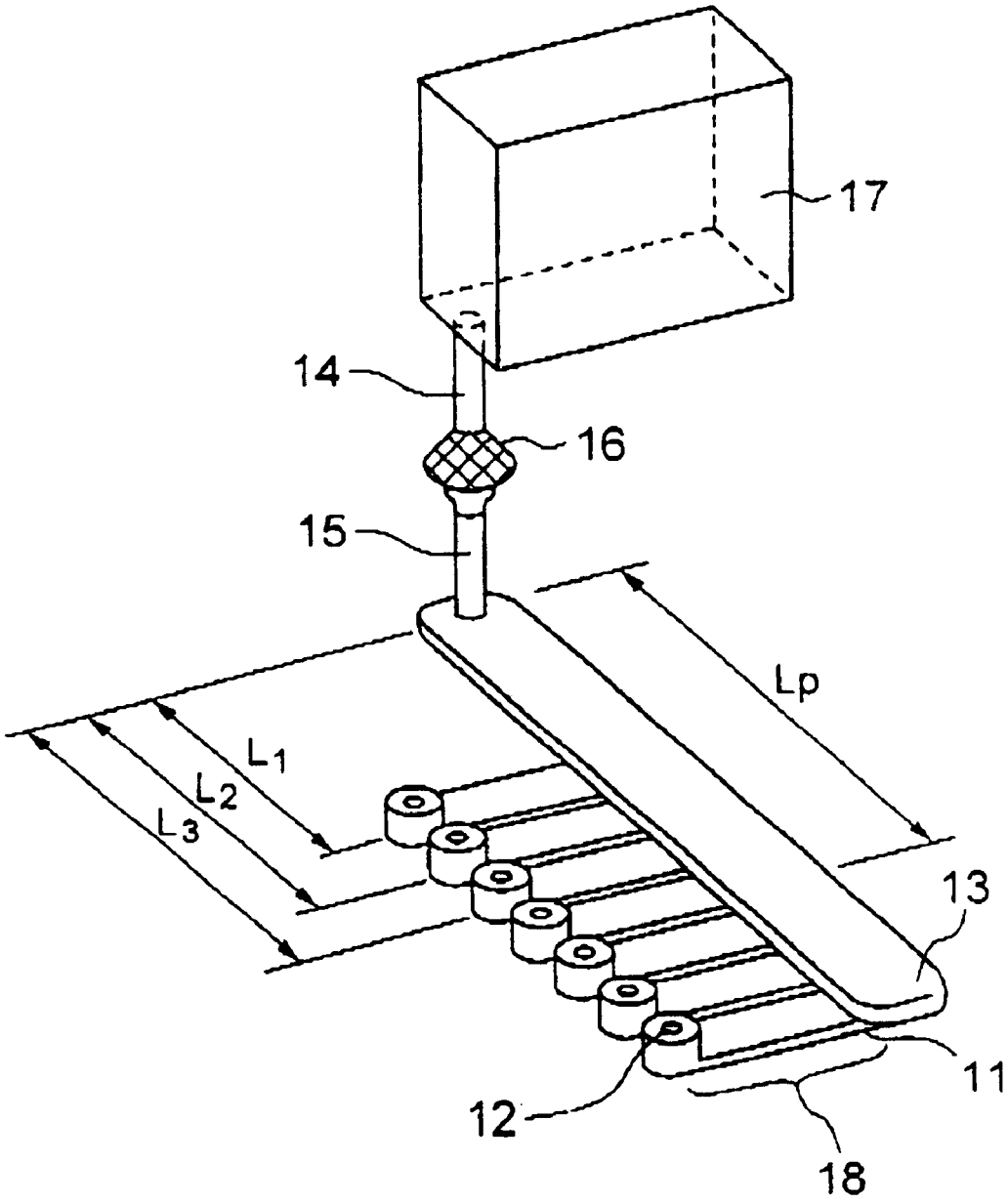
FIG. 11 is a perspective view of an ink jet recording head according to a first embodiment of the present invention.

Referring to FIG. 11, an ink jet recording head according to a first embodiment of the present invention has a configuration similar to the configuration shown in FIGS. 1 and 5 except for the dimensions therein. The body of the ink jet recording head is formed by bonding a plurality of thin plates or films each having therein a plurality of punched holes. In this example, a plurality of stainless steel plates each having a thickness around 50 to 70 $\mu$m are stacked one on another by using thermo-setting adhesive layers each having a thickness of about 5 $\mu$m.

The ink jet recording head of the present embodiment has 64 ejectors 18 in number, among which seven ejectors are specifically shown in the drawing. The ejectors 18 are communicated together via the common ink passage 13. The common ink passage 13 is communicated with an ink reservoir 17 via a first pipe line 15, a filter 16 and a second pipe line 14, having a function of introducing the ink from the ink reservoir to the pressure chambers 11. In this embodiment, the common ink passage 13, first pipe line 15, filter 16, second pipe line 14 and ink reservoir 17 constitute an ink supply system.

Referring again to FIG. 1, each ejector of the ink jet recording head shown in FIG. 11 has a pressure chamber 61 communicated with the common ink passage 63 via an ink inlet port 64 and filled with ink. The ink has a viscosity of 3 mPa·s and a surface tension of 35 mN/m, for example. Each pressure chamber 61 is associated with a nozzle 62 for ejecting the ink from the pressure chamber 61. In this embodiment, the nozzle 62 and the ink inlet port 64 have a common structure including an opening having a diameter of 30 $\mu$m and a taper portion having a length of 65 m. The openings are formed by pressing.

The pressure chamber 61 is provided with a diaphragm 65 at the bottom of the pressure chamber 61. A piezoelectric actuator 66 applies a mechanical force to the pressure chamber 61 via the diaphragm 65 to increase or decrease the volume of the pressure chamber 61. The diaphragm 65 is implemented by a thin nickel plate shaped by a electro-forming process. The piezoelectric actuator 66 is implemented by stacked piezoelectric ceramic plates. The piezoelectric actuator 66 is driven by a drive circuit (not-shown) to change the volume of the pressure chamber 61, thereby generating a pressure wave in the pressure chamber 61. The pressure wave moves the ink in the vicinity of the nozzle 62, ejecting the ink from the nozzle 62 as an ink droplet 67. The refill time of the ink jet recording head is about 60 micro-seconds when an ink droplet having a volume of 25 pico-litters is ejected from a single ejector at a low frequency of 1 kHz.

Back to FIG. 11, in the ink jet recording head of the present embodiment, the common ink passage 13 has a width of 2.5 mm, a height of 215 $\mu$m, and a length (Lp) of 20 mm. In this case, the flow resistance of the common ink passage 13 is calculated at $1\times10^{10}$ Ns/m$^5$. In the configurations of the common ink passage 13 and the communication therefrom to the ejectors 18, the ejectors 18 have different flow lengths as viewed from the common ink passage 13, which are L1, L2, L3, . . . , as shown in FIG. 11. In such case, an accurate calculation for the flow resistance should be preferably based on the equivalent circuit diagram shown in FIG. 9. However, a practical flow resistance can be obtained by a simplified configuration that the flow lengths for all the ejectors 18 are determined based on the central ejector at a length of Lp. An air damper made of resin film formed as the bottom plate of the common ink passage 13 assures a sufficient acoustic capacitance of the common ink passage 13.

Each of the pipe lines 14 and 15 has a circular cross section, and has an inner diameter of 1.2 mm and a length of 5 mm. Each pipe line has a flow resistance of $2.9\times10^8$ Ns/m$^5$. The filter 16 is made of a metallic mesh having a mesh size of about 10 $\mu$m. The flow resistance of the filter 16 was measured at $1.2\times10^9$ Ns/m$^5$. The ink reservoir 17 has a flow resistance as low as $2\times10^8$ Ns/m$^5$ due to the larger cross section thereof.

Figure 12:
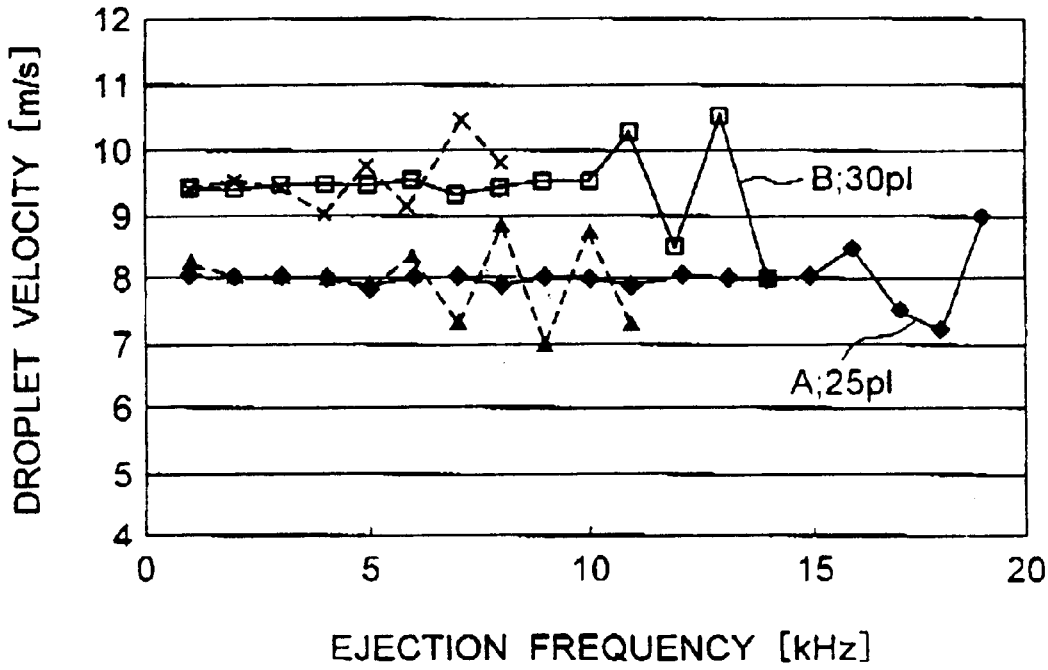
FIG. 12 is a graph showing the relationship between the droplet velocity and the ejection frequency in the ink jet recording head of the first embodiment, with the droplet volume being a parameter.

The ink jet recording head of the present embodiment was subjected to measurements of droplet velocities thereof while changing the ejection frequency and the droplet volume during the ejection. The results are shown in FIG. 12. The ink supply system had a total flow resistance of $3.3\times10^{10}$ Ns/m$^5$. This allows 800 Pa or below for the pressure drop in the common ink passage 13 if the ink supply rate is $2.4\times10^{-8}$ m$^3$/s or below, whereby the formula (3) can be satisfied.

Accordingly, for a droplet volume of 25 pico-litters, as shown in FIG. 12, a stable ejection or a substantially constant droplet velocity could be obtained at an ejection frequency of 15 kHz or below, which corresponds to an ink supply rate of $2.4\times10^{-8}$ m$^3$/s as shown in FIG. 12. A larger droplet volume of 30 pico-litters also provided a stable ejection or a constant droplet velocity up to an ejection frequency of about 10 kHz, as shown in the same drawing.

It is to be noted that an ink jet recording head having ejectors in number 64 or above achieves a high-speed printing, as high a printing speed as two sheets per minute for A4 size, if an ink droplet having a volume of 15 pico-litters or above is ejected at an election frequency of 15 kHz or above.

For comparison, a comparative ink jet recording head having a similar configuration except for the height of the common ink passage which is 0.15 mm in the comparative recording head was fabricated and subjected to similar measurements. In the comparative recording head, the total flow resistance was about $9.1\times10^{10}$ Ns/m$^5$. The results of the measurements are shown by dotted lines in FIG. 12. As understood from the drawing, the comparative recording head suffered from a pressure drop above 800 Pa in the common ink passage for an ink supply rate of $0.88\times10^{-8}$ m$^3$/s or above. This means that the formula (3) is not satisfied when ink droplets having a volume of 25 pico-litters are ejected at a frequency of 15 kHz or more. In the experiments conducted, it was confirmed that an ejection frequency of 6 kHz or above revealed an unstable droplet velocity. Observation of the droplets by a stroboscope revealed an ejection state wherein large-volume droplets and small-volume droplets were alternately ejected. It was observed that a larger droplet volume of 30 pico-litters revealed an unstable ejection at an ejection frequency of 4 kHz or above. It is to be noted that, diving at a lower ejection frequency achieved a stable ejection for all the nozzles, and thus the acoustic capacitance of the common ink passage was sufficiently large in the ink jet recording heads.

As understood from the above experiments, it is confirmed that a larger acoustic capacitance alone does not necessarily provide a stable high-frequency ejection. This means that a stable simultaneous ejection by all the nozzles may be possibly obtained only by designing an optimum flow resistance for the common ink passage in relation to the droplet volume, number of nozzles and maximum ejection frequency as well as designing a suitable acoustic capacitance.

Figure 13:
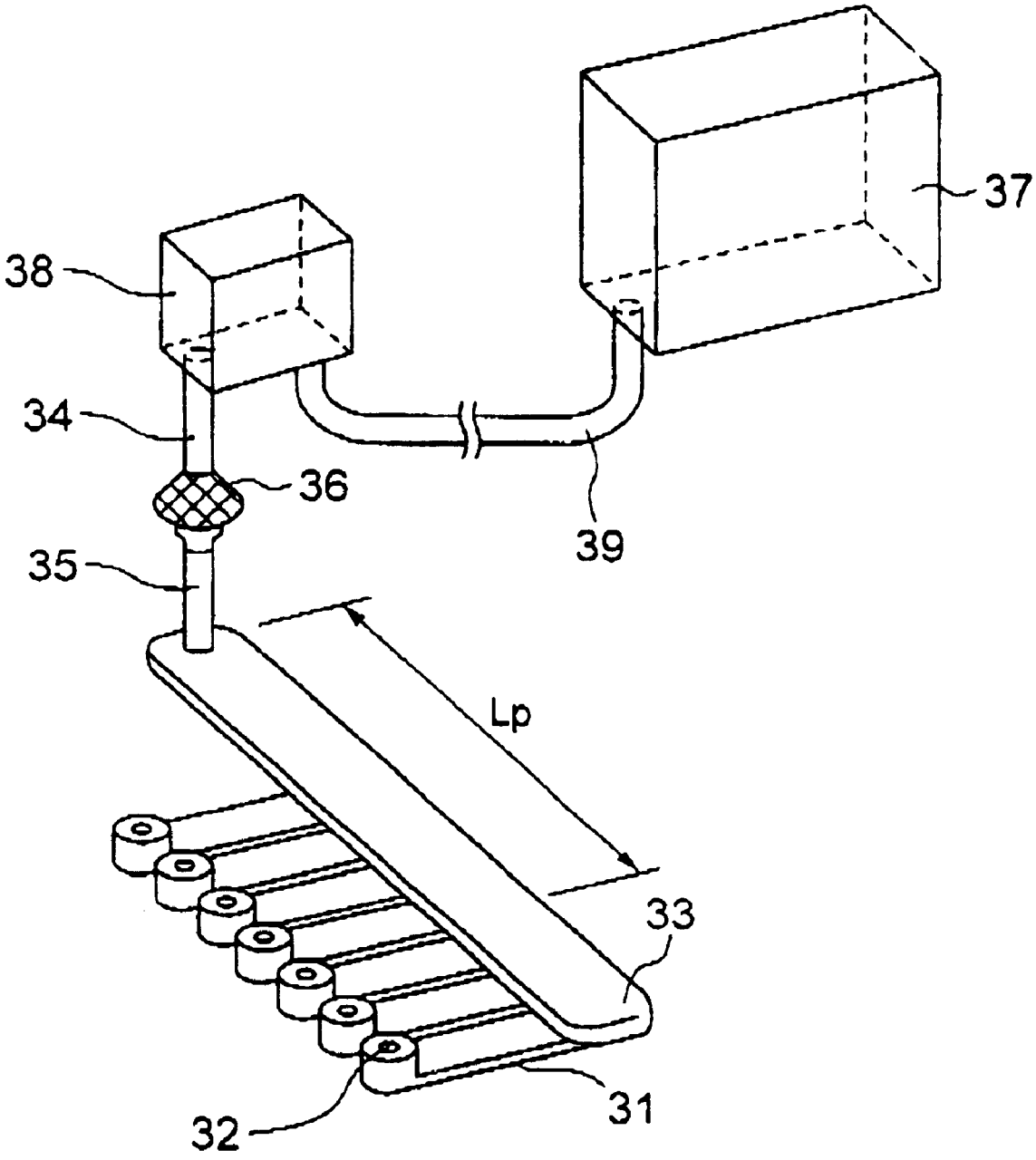
FIG. 13 is a perspective view of an ink jet recording head according to a second embodiment of the present invention.

Referring to FIG. 13, an ink jet recording head according to a second embodiment of the present invention is similar to the first embodiment in the basic structure thereof. The ink jet recording head of the present embodiment includes an auxiliary reservoir 38 and an ink tube 39 provided between the ink reservoir 37 and the second pipe line 34, both of which are similar to those in the first embodiment. The ink jet recording head has 128 ejectors in number. In the present embodiment, the ink reservoir 37 having a larger volume is disposed separately from the ink jet recording head, and connected to the ink jet recording head via the ink tube 39 having a length as large as 400 mm. It may be considered that the large number of ejectors and the long ink tube 39 in the present embodiment may cause an unstable simultaneous ejection.

In the present embodiment, however, the ink tube 39 has an inner diameter as large as 2 mm, which suppresses the flow resistance of the ink tube down to $3.1\times10^9$ Ns/m$^5$. The common ink passage 33 also has a large height of 310 $\mu$m, with a width of 2.5 mm and a length of 29 mm, which suppresses the flow resistance of the common ink passage 33 down to $1.0\times10^{10}$ Ns/m$^5$. By also reducing the flow resistance of other components, the overall flow resistance of the ink supply system from the ink reservoir 37 to the common ink passage 33 is as low as $1.25\times10^{10}$ Ns/m$^5$, which allows the formula (3) to be satisfied even when 128 ejectors simultaneously eject ink droplets at an ejection frequency of 20 kHz.

The ink jet recording head of the present embodiment was operated while changing the ejection frequency and the droplet volume, and observed for the ejection state thereof. It was confirmed from the observation that the droplet velocity was constant up to an ejection frequency of 21 kHz for the case of a droplet volume of 25 pico-litters. It was also confirmed that a stable ejection was possible up to an ejection frequency of 17 kHz for the case of a droplet diameter of 30 pico-litters. It is to be noted that 128 ejectors ejecting respective ink droplets having a volume of 25 pico-litters at an ejection frequency of 21 kHz can achieve a sufficient printing speed as high as 10 sheets/minute.

For comparison, a comparative ink jet recording head having a similar structure except for the inner diameter of the ink tube, which was 1 mm, was operated similarly to the present embodiment. The resultant flow resistance of the inner tube in the comparative ink jet recording head was as high as $4.9\times10^{10}$ Ns/m$^5$, which resulted in $5.8\times10^{10}$ Ns/m$^5$ for the overall flow resistance of the ink supply system. The ejection was unstable at frequencies above 5 kHz for the case of a droplet volume of 25 pico-litters, and above 4 kHz for the case of a droplet volume of 30 pico-litters.

As described above, the ink jet recording head of the present embodiment satisfies the formula (3) at a higher ejection frequency by setting the inner diameter etc. of the ink tube at a suitable value even for the case of an ink tube having a larger length.

Figure 14:
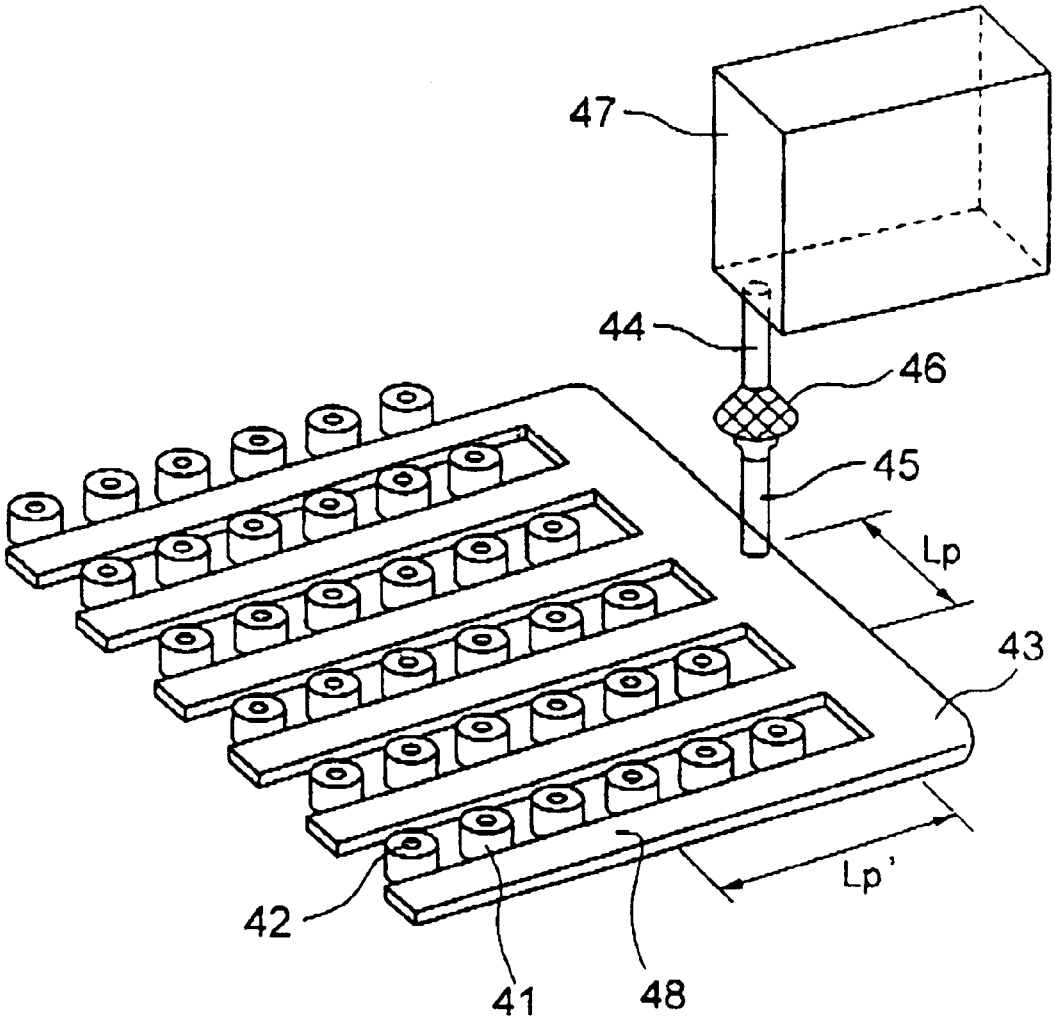
FIG. 14 is a perspective view of an ink jet recording head according to a third embodiment of the present invention.

Referring to FIG. 14, an ink jet recording head according to a third embodiment of the present invention is similar to the first embodiment except for arrangement of the ejectors, which are arranged in a matrix, and the structure of the ink supply system. The ink supply system has a common ink passage including a mainstream 43 and a plurality of branch streams 48 (24 in number) each corresponding to the number (8) of the ejectors disposed in a column. This matrix arrangement allows a high-density arrangement of the 192 ejectors. The high-density arrangement of the ejectors necessitates a further lower flow resistance of the ink supply system.

The main stream 43 is 2.5 mm wide, 400 $\mu$m high, and 15 mm(Lp) long in average. The branch stream 48 is 1 mm wide, 400 $\mu$m high, and 8 mm long in average for the ejectors. This arrangement provides $9.7\times10^{10}$ Ns/m$^5$ for the total length of the common ink passage. The main stream 43 of the common ink passage receives ink at the center of the main stream 43 for reducing the effective flow resistance.

The first and second pipe lines 45 and 44 have a cylindrical shape which has an inner diameter of 1.2 mm and a total length of 5 mm. This provides $2.9\times10^8$ Ns/m$^5$ for the flow resistance of the pipe lines. The filter 46 has a flow resistance of $5.0\times10^8$ Ns/m$^5$, whereas the ink reservoir 47 has a flow resistance of $5.2\times10^8$ Ns/m$^5$. Thus, the ink supply system has a total flow resistance of $1.1\times10^{10}$ Ns/m$^5$. A simultaneous ejection by the 192 ejectors satisfies formula (3) at an ejection frequency of 15 kHz for a droplet volume of 25 pico-litters.

The ink jet recording head of the present embodiment was operated while changing the ejection frequency and the droplet volume, and observed for the ejection state thereof. It was confirmed from the observation that the droplet velocity was constant up to an ejection frequency of 16 kHz for the case of a droplet volume of 25 pico-litters, thereby achieving a stable ejection. It was also confirmed that a stable ejection was possible up to 13 kHz for the case of a droplet volume of 30 pico-litters. It is to be noted that 192 ejectors ejecting respective ink droplets having a volume of 25 pico-litters at an ejection frequency of 16 kHz can achieve a sufficient printing speed as high as 14 sheets/minute.

An ink jet recording head according to a fourth embodiment of the present invention is similar to the first embodiment shown in FIG. 11 except for the dimensions of the common ink passage 13, pipe lines 14 and 15 and the filter 16. More specifically, the common ink passage 13 is 320 $\mu$m high, the pipe lines 14 and 15 have an inner diameter of 1.5 mm, and the filter 16 has a diameter double the diameter of that in the first embodiment. The ink used has a higher viscosity of 10 mPa for suppressing ink infiltration and improving the printing quality on a regular paper.

By increasing the cross-sectional areas of the pipe lines and the filter, the flow resistance of the ink supply system is suppressed down to $3.3\times10^9$ Ns/m$^5$ which is equivalent to that of the first embodiment, even for the case of a higher ink viscosity of 10 mPa. Thus, a simultaneous ejection by the ejectors satisfies formula (3) and achieves a pressure drop equal to or below 800 Pa for the case of an ink supply rate of $4\times10^{-8}$ cm$^3$/s.

Figure 15:
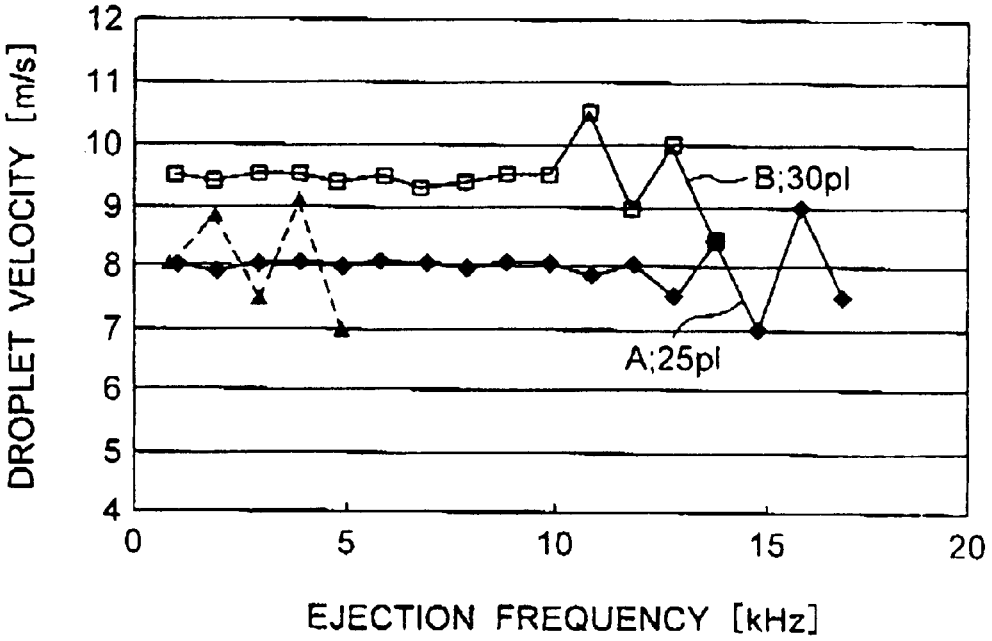
FIG. 15 is a graph showing the relationship between the droplet velocity and the ejection frequency in an ink jet recording head according to a fourth embodiment of the present invention, with the droplet volume being a parameter.

The ink jet recording head of the present embodiment was operated while changing the ejection frequency and the droplet volume, and observed for the ejection state thereof. The results are shown in FIG. 15, which reveals that the droplet velocity was constant up to an ejection frequency of 12 kHz for the case of a droplet volume of 25 pico-litters, thereby achieving a stable simultaneous ejection. It is also confirmed that a stable ejection was possible up to an ejection frequency of 10 kHz for the case of a droplet volume of 30 pico-litters. The present embodiment revealed that a stable iterative ejection is possible at a higher frequency range for the case of a higher ink viscosity. It is noted that the maximum ejection frequency in the present embodiment is somewhat lower than that in the first embodiment because the higher ink viscosity increases the refill time.

For comparison, a comparative ink jet recording head having a similar structure except for the height of the common ink passage, which was 150 $\mu$m, inner diameter of the ink tube which was 1.2 mm, and the size of the filter which was similar to that in the first embodiment, was operated similarly to the present embodiment. The results of the measurements are shown in FIG. 15 by dotted lines. The ejection was unstable at frequencies above 2 kHz for the case of a droplet volume of 25 pico-litters, and some nozzle exhibited non-ejection above 2 kHz. The interior of the nozzles which exhibited the non-ejection was investigated to reveal introduction of air bubbles in the nozzle, which apparently meant a refill defect.

As described above, the ink jet recording head of the present embodiment achieves a stable simultaneous ejection at a higher ejection frequency by setting the flow resistance at a suitable value based on the droplet diameter, number of ejectors and the ejection frequency, for the case of a higher ink viscosity.

Generally, the conventional ink jet recording head uses an ink having a viscosity of around 3 mPa·s. An ink having a higher viscosity of 5 mPa·s can improve the image quality by reducing ink infiltration on the recording sheet. In addition, high-performance inks such as having a higher weather-resistance or a ultraviolet-ray cured property generally has a viscosity above 5 Pa·s. Thus, the ink jet recording head of the above embodiments which can use the high-viscosity inks has an advantage over the conventional ink jet recording head.

In the above embodiments, a piezoelectric actuator is used as a pressure wave generator. However, the present invention is applicable to an ink jet recording head having other pressure wave generators such as an electro-mechanic transducer which uses electrostatic or magnetic force, or an electro-thermo transducer which uses boiling for generating a pressure wave. In addition, the piezoelectric actuator may be a single-plate actuator or other type actuators instead of the stacked piezoelectric actuator. The Caesar-type ink jet recording head as used in the above embodiment may be replaced by another type such as having a pressure chamber formed in a trench provided on the piezoelectric actuator.

The present invention may be applied to an ink jet recording head using a mono-color ink as well as a colored ink, or printing on a recording medium other than a regular recording sheet. The recording medium may be a high-polymer film or a glass plate, which may be used as a color filter after printing. Further, a bump may be formed by ejecting molten solder from a nozzles onto a substrate by using the technique as described above. Further, The present invention is also applicable to general liquid ejectors used in a variety of industries.

The simultaneous ejection in the above embodiment may be such that the ejectors eject ink droplets at a small time interval therebetween so long as the flow in the ink supply system is suitably viewed as a static flow. The simultaneous ejection may be effected by some of all the ejectors disposed in the ink jet recording head. For example, half the ejectors such as odd-numbered or even numbered ejectors among all the ejectors may eject ink droplets instead of ejection by all the ejectors. In addition, each pressure chamber may be associated with a plurality of actuators.

Since the above embodiments are described only for examples, the present invention is not limited to the above embodiments and various modifications or alterations can be easily made therefrom by those skilled in the art without departing from the scope of the present invention.

What is claimed is:

1. An ink jet recording head comprising an ink supply system including an ink reservoir and a common ink passage communicated to said ink reservoir, and a plurality of pressure chambers each communicated to said common ink passage, each of said pressure chambers including an ink nozzle for ejecting ink from a corresponding one of said pressure chambers, wherein a flow resistance r[Ns/m$^5$] of said ink supply system generated during a substantially static ink flow satisfies the following relationship:

$$r<800/(q\cdot N\cdot f),$$

wherein q, N and f represent a droplet volume [m$^3$] of an ink droplet ejected by each of said nozzles at a time, a number of said pressure chambers and an ejection frequency for ejecting said ink droplets, respectively.

2. The ink jet recording head as defined in claim 1, wherein said flow resistance r of said ink supply system includes a first resistance r1 of a first portion of said ink supply system having a circular cross section and a second resistance r2 of a second portion of said ink supply system having a rectangular cross section, said r1 and r2 being calculated from the following formulas:

$$r\mathbf{1}=\Sigma(128\eta L\mathbf{1}/\pi d^4);$$

and $$r\mathbf{2}=\Sigma[128\eta L\mathbf{2}\{0.33+(z+1/z)\}/S^2],$$

wherein η, L1, d, L2, z and S are ink viscosity [Pa·s], length of said first portion, diameter of said first portion, length of said second portion, aspect ratio of said cross section of said second portion, and cross-sectional area of said second portion, respectively.

3. The ink jet recording head as defined in claim 1, wherein said droplet volume q is $1.5\times10^{-14}$ m$^3$ or above, and said ejection frequency f is 10 kHz or above.

4. The ink jet recording head as defined in claim 1, wherein said number N of pressure chambers is 64 or above.

5. The ink jet recording head as defined in claim 1, wherein said inks viscosity η is 5 mPa·s or above.

6. The ink jet recording head as defined in claim 1, wherein said ink supply system further includes an auxiliary reservoir and an ink tube between said ink reservoir and said common ink passage.

7. The ink jet recording head as defined in claim 1, wherein said common ink passage includes a main stream and a plurality of branch streams communicated to said main stream, said plurality of nozzles being arranged in a matrix, a column of said nozzles being arranged along one of said branch streams.

8. The ink jet recording head as defined in claim 1, wherein said pressure chamber is associated with one of a piezoelectric actuator, an electro-mechanic transducer and an electro-thermo transducer.

9. The ink jet recording head is defined in claim 1, wherein said nozzles eject ink droplets onto one of recording sheet, polymer film and glass plate, said ink droplets including one of ink and molten solder.

10. A method for designing an ink jet recording head having an ink supply system including an ink reservoir and a common ink passage communicated to said ink reservoir, and a plurality of pressure chambers each communicated to said common ink passage, each of said pressure chambers including an ink nozzle for ejecting ink from a corresponding one of said pressure chambers, said method comprising the step of determining a flow resistance of said ink supply system during a static flow in said ink supply system to suppress a refill time for each of said nozzles down to below a specified ejection frequency designed for said nozzles;

wherein said flow resistance r [Ns/m5] of said ink supply system generated during a static ink flow is designed to satisfy the following relationship:

$$r<800/(q-N-f)$$

wherein q, N and f represent a droplet volume [m$^3$] of an ink droplet ejected by each of said nozzles at a time, a number of said pressure chambers and an ejection frequency for said ink droplets, respectively.

* * * * *

UNITED STATES PATENT AND TRADEMARK OFFICE

CERTIFICATE OF CORRECTION

PATENT NO. : 6,609,784 B2
DATED : August 26, 2003
INVENTOR(S) : M. Okuda

It is certified that error appears in the above-identified patent and that said Letters Patent is hereby corrected as shown below:

Title page,
Item [73], Assignee, should be changed as follows:
Delete "Fuji Zerox Co., Ltd," and substitute -- Fuji Xerox Co., Ltd. --

Signed and Sealed this

Sixth Day of July, 2004

JON W. DUDAS
*Acting Director of the United States Patent and Trademark Office*